US006957027B2

(12) United States Patent
Hooper

(10) Patent No.: US 6,957,027 B2
(45) Date of Patent: Oct. 18, 2005

(54) TONER CARTRIDGE CONVERTER

(75) Inventor: Howard Hooper, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 51 days.

(21) Appl. No.: 10/654,550

(22) Filed: Sep. 3, 2003

(65) Prior Publication Data

US 2004/0081482 A1 Apr. 29, 2004

Related U.S. Application Data

(63) Continuation of application No. 10/280,655, filed on Oct. 24, 2002, now Pat. No. 6,654,577.

(51) Int. Cl.[7] ..... G03G 15/00
(52) U.S. Cl. ..... 399/109
(58) Field of Search ..... 399/107, 109, 399/111, 149, 360, 120, 123; 347/138, 152

(56) References Cited

U.S. PATENT DOCUMENTS 4,985,734 A * 1/1991 Honda et al.
5,182,601 A * 1/1993 Hodoshima et al.
5,426,493 A * 6/1995 Oyler ..... 399/109
5,870,654 A * 2/1999 Sato et al. ..... 399/109
6,621,996 B1 * 9/2003 Meyer et al. ..... 399/109

FOREIGN PATENT DOCUMENTS

JP 09179468 A * 7/1997 ..... G03G/21/10

* cited by examiner

*Primary Examiner*—Arthur T. Grimley
*Assistant Examiner*—Ryan Gleitz

(57) ABSTRACT

A converter for converting a non waste-residue collecting toner cartridge to a waste-residue collecting toner cartridge, a method for converting a non waste-residue collecting toner cartridge to a waste-residue collecting toner cartridge, and a waste-residue-collecting converted toner cartridge.

16 Claims, 2 Drawing Sheets

TONER CARTRIDGE CONVERTER

CROSS REFERENCE TO RELATED

APPLICATION(S)

This is a continuation of application Ser. No. 10/280,655 filed on Oct. 24, 2002, now U.S. Pat. No. 6,654,577, which is hereby incorporated by reference herein.

BACKGROUND

In electrophotographic printing, such as in laser printers and copiers, a pattern of electrostatic charges corresponding to a print image is developed on an optical photoconductor using radiated energy, either visible spectrum light or optical energy outside the visible light spectrum. Conventionally, near infrared laser light is used to develop an electrostatic image on the optical photoconductor. The optical photoconductor is usually a continuous surface such as a drum or belt.

The laser light scans across the charged surface of photosensitive material on the optical photoconductor in a succession of scan lines. Each scan line is logically divided into picture element (pixel) areas and the laser beam is modulated such that selected pixel areas are exposed to light. Pixel size (or pixel space) is defined by a given dot pitch, scan velocity and spot size of the printer. The exposure to light results in the reduction of voltage on the optical photoconductor at those select pixel locations forming a latent image pattern. Subsequently, toner is applied (deposited) onto those pixel locations to form a visible image and this image is then transferred to a print media (typically a sheet of paper).

In many electrophotographic printing devices, the supply of toner, the optical photoconductor and other associated components are housed in a separate toner cartridge that is easily inserted or removed from the printing device. The construction and operation of toner cartridges are well know in the art. Toner cartridges are described in U.S. Patent Application Publication US 2001/0041079 A1 filed Nov. 15, 2001 of Michlin et al., U.S. Patent Application Publication US2001/0055949 A1 filed Dec. 27, 2001 of Katakabe et al., U.S. Pat. No. 6,128,448 filed Oct. 3, 2000 of Arcaro et al., and U.S. Pat. No. 5,758,224 filed May 26, 1998 of Binder et al., each of which is hereby incorporated by reference for all that it discloses.

Traditional toner cartridges for printers generally employ toner products that leave waste-residue which must be removed to prevent printer malfunction and poor printed product. Accumulation of such waste-residue generally occurs within a waste-residue hopper situated in association with a blade that scrapes the waste-residue from a photoconductor drum located within the cartridge as the photoconductor drum rotates during routine printer operation. This so-removed waste-residue then enters the waste-residue hopper for retention.

Recently, however, new toner cartridges have been developed for printers wherein these newly developed cartridges initially are supplied with non waste-residue organic toner products that leave no waste-residue for collection. As a result, such cartridges no longer include a waste-residue collection site. When a user merely discards these new toner cartridges after their respective toner supplies are depleted, no problem exists since no re-use of such cartridges occurs. However, if the user does, in fact, wish to pursue a re-use program where only waste-residue-producing toner is available for replacement of spent non waste-residue toner, a very significant problem occurs, since no waste-residue collection site is present for the accumulation of such waste-residue. Additionally, of course, no waste-residue remover scraper is present for removing such waste-residue from the photo conductor drum. Consequently, printed work product quickly becomes unacceptable. Thus any toner recharge of such non waste-residue toner cartridges has heretofore been substantially unsatisfactory.

BRIEF SUMMARY

The present subject matter includes a converter for converting a non waste-residue collecting toner cartridge to a waste-residue collecting toner cartridge, a method for converting a non waste-residue collecting toner cartridge to a waste-residue collecting toner cartridge, and a converted toner cartridge.

DETAILED DESCRIPTION

An embodiment of a converter for converting a non-waste-residue collecting toner cartridge may include a waste-residue collection site and a waste-residue remover associateable with a photoconductor drum disposed within the cartridge. The waste-residue collection site may be placeable such that it is proximate the photoconductor drum for accumulation of waste-residue removed from the photoconductor drum. The waste collection site, in one embodiment, may be removed from the cartridge, emptied, and replaced for continued use.

Methodology for converting a non waste-residue collecting toner cartridge to a waste-residue collecting toner cartridge may include positioning a waste-residue collection site proximate the photo conductor drum as earlier described. The method may further include positioning a waste-residue remover such that waste-residue may be removed from the photo conductor drum and thereafter deposited into the waste-residue collection site.

The converted toner cartridge may include a housing, a photo conductor drum, and a waste-residue converter as described above. The converter may be releasably mounted within the cartridge such that the converter may be removed from the cartridge housing, emptied, and replaced within the housing for continued use.

Figure 1:
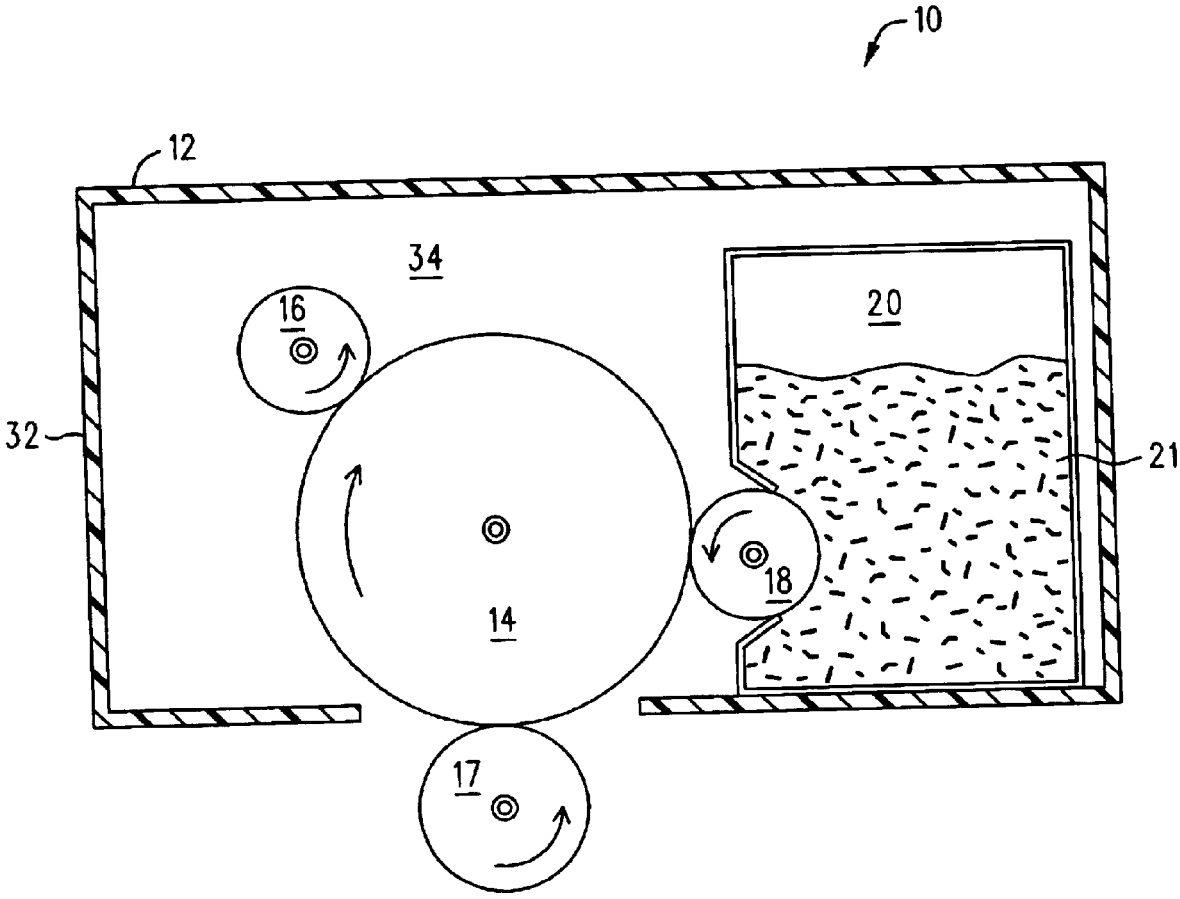
FIG. 1 (PRIOR ART)
FIG. 1 is a schematic side elevation view in section of one embodiment of a non-waste-residue collecting toner cartridge.

FIG. 1 shows an embodiment of a non-converted toner cartridge 10 having a housing 12 schematically shown in cross section. The cartridge 10 may include a photo conductor drum 14, a charge roller 16, a developer 18, and a toner reservoir 20 with toner 21 therein. In some cartridge embodiments a transfer roller 17 is mounted within the cartridge and is positioned immediately adjacent to the conductor drum. In other embodiments, as shown in FIG. 1, the transfer roller 17 is mounted in an associated printer and is not mounted within the cartridge 10. As is well known in the art, an energy beam such as a laser is directed through an opening (not shown) in the housing 12 onto the photoconductor drum 14 causing selective charging of certain surface portions thereof which defines the shape of an image which will be applied to media such as paper (not shown). Toner 21 from hopper 20 is applied to photoconductor drum 14 by developer roller 18. Charge roller 16 conditions the drum by applying a predetermined, uniform charge thereto. Alternatively, a charge corona (not shown) is used for this purpose. Paper or other media to be printed (not shown) passes between photoconductor drum 14 and a transfer roller 17, or alternatively, a transfer corona (not shown). Toner on the surface of photoconductor drum 14 is deposited on the paper as it passes between drum 14 and transfer roller 17. Because the cartridge 10 originally is charged with a non waste-residue producing toner, no initial need is present for cleaning the photo conductor drum 14. Consequently, the cartridge 10 is not originally provided with a waste-residue collection site. Once the non waste-residue producing toner is expended from the reservoir 20, the cartridge 10 is designed to be discarded. When such disposal is not made, however, and recharging the cartridge with traditional waste-residue-producing toner is performed, image producing capability of the cartridge 10 soon breaks down because waste-residue now produced cannot be removed from the photo conductor drum 14.

Figure 2:
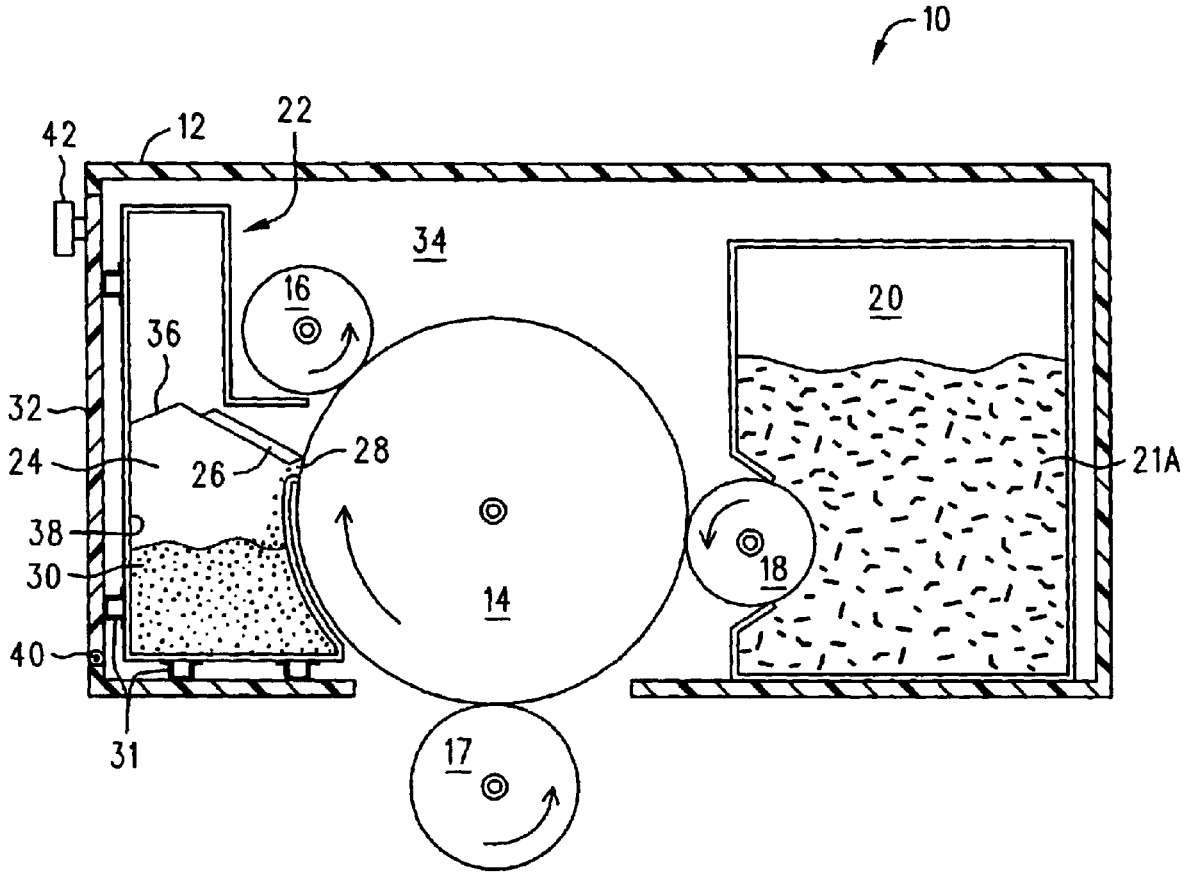
FIG. 2 is a schematic side elevation view in section of the embodiment of the toner cartridge of FIG. 1 modified with a converter converting the toner cartridge to a waste-residue collecting toner cartridge.

FIG. 2 shows an embodiment of toner cartridge modification that alleviates this problem and permits recharging of the cartridge 10 with traditional waste-residue-producing toner. In particular, the toner reservoir 20 of the cartridge 10 may be filled with the waste-residue-producing toner 21A; and thereafter a converter 22 may be added to the cartridge 10. The converter 22 may include a waste collection site, which may be a waste-residue hopper 24, and a waste-residue remover, which may be a scraper blade 26, mounted next to the drum 14. In one embodiment the blade 26 is attached to the waste-residue hopper 24. Such attachment may be accomplished by any suitable connector such as by use of a formed metal bracket or a spring-tensioned wire 36 projecting from an interior wall 38 of the waste-residue hopper 24 to thereby bias the scraper blade 26 against the photo conductor drum 14. An opening 28 in the sidewall of the waste-residue hopper 24 permits entry of waste scraped from the drum 14 into the waste-residue hopper 24. The waste-residue hopper 24 may be generally situated such that gravity may cause travel of waste residue removed from the drum 14 through the opening 28 and into the waste-residue hopper 28. The scraper blade 26 may be generally located to project within the opening 28 of the waste-residue hopper 24 and scrape the photo conductor drum 14 upon drum rotation which occurs during operation of the cartridge 10. Such scraping of the photo conductor drum 14 removes waste-residue 30 from the photo conductor drum 14 and directs that waste-residue 30 into the waste-residue hopper 24 for accumulation therein. The blade may be of the same type used in traditional waste-residue collecting toner cartridges. As earlier described, such deposition of waste-residue 30 into the waste-residue hopper 24 may be by gravitational force where at least a portion of the opening 28 of the hopper 24 is disposed generally beneath the photo conductor drum 14. The converter 22 may be removable from the cartridge 10 for emptying the waste-residue hopper 24 thereof as may be required during operation of the cartridge 10 through its first or a subsequent toner recharge period.

The toner cartridge 10 may have a door 32 leading from the exterior thereof to a void 34 within the housing 12 whereby the converter 22 may pass into the void 34 for substantially complete accommodation therein and ultimate closure of the door 32. The door 32 may be provided with a hinge 40 and pull-knob 42, and may be releasably retained in a closed state such as by friction fit thereof with the surrounding housing 12, a latch or other retention device. Spacers 31 and/or attachment devices such as adhesive pads or the like (not shown) may be used to properly position the converter within the housing 12. Alternatively, the waste residue hopper 28 may be sized to precisely fit in void 34 in proper relationship with drum 14.

Whenever the waste-residue hopper 24 requires emptying, a user may easily open the door 32, remove the converter 22 from the housing 12, empty the waste-residue hopper 24, and thereafter reinsert the converter 22 into the void 34 of the housing 12 and close the door 32. Alternatively, the user may simply discard the removed converter and replace it with a new converter.

The toner cartridge 10 has been shown in simplified schematic form to facilitate description of the invention. It is of course understood that a non-waste-residue collecting toner cartridge to be modified in accordance with the teaching of this disclosure may be of any shape and may include operating components other than or in addition to those described herein. Accordingly, a non waste-residue collecting toner cartridge to be converted could be the same shape and could include the same operating components, except for the waste hopper and associated waste collection components, as those of any of the above patents and patent application publications incorporated by reference herein. Similarly, although an access door in the cartridge housing was specifically described herein as the means for insertion and removal of the converter 22 from the housing it is to be understood that the converter 22 could be inserted and removed in various other ways. For example, access through the housing wall might be accomplished through cutting out and removing a portion of the sidewall and subsequently refastening the removed section, after insertion of the converter, as by use of attachment brackets, adhesive tape or other attachment means. Also, the converter 22 could be provided as a unit that includes its own housing portion which replaces a removed portion of the original cartridge housing 12. Such a to-be-removed portion of the original housing 12 may be constructed to be readily removable; for example it may be attached to another portion of the original housing 12 by screws, clamps, break-away tabs, or other means that facilitate quick removal. Alternatively, removal of the to-be-removed portion could be accomplished as by cutting away the to-be-removed portion.

Thus, although certain embodiments of the invention have been expressly described herein, it is to be understood that the invention may be variously otherwise embodied. The appended claims are to be construed to cover all such embodiments, except to the extent limited by the prior art or express limitations of the subject claims.

What is claimed is:

1. A method comprising:

providing a non waste-residue collecting toner cartridge comprising a housing and a photo conductor drum;

providing a waste-residue converter comprising a waste-residue collection site and a waste-residue remover;

converting said non waste-residue collecting toner cartridge to a waste-residue collecting toner cartridge by installing said waste-residue converter at least partially within said housing.

2. The method of claim 1 wherein said installing said waste-residue converter comprises locating an opening in said waste-residue collection site proximate said photo conductor drum.

3. The method of claim 1 wherein said installing said waste-residue converter comprises operatively associating said waste-residue remover with said photo conductor drum.

4. The method of claim 1 and further comprising providing a door in said housing.

5. The method of claim 4 wherein said installing said waste-residue converter comprises inserting said waste-residue converter into said housing through said door.

6. The method of claim 4 wherein said door is releasably retained in a closed configuration in relation to said housing.

7. The method of claim 1 wherein said waste-residue collection site is a waste-residue hopper.

8. The method of claim 1 wherein said waste-residue remover is a scraper.

9. A toner cartridge comprising:

a housing; and a photo conductor drum located at least partially within said housing;

wherein, said toner cartridge comprises at least a first operating condition and a second operating condition;

wherein, in said first operating condition, a waste-residue collection site is not located within said housing; and wherein in said second operating condition, a waste-residue collection site is located within said housing.

10. The toner cartridge of claim 9 wherein, in said second operating condition, said waste-residue collection site comprises an opening proximate said photo conductor drum.

11. The toner cartridge of claim 9 wherein:

in said second operating condition, a waste-residue remover is operably associated with said photo conductor drum; and in said first operating condition, said waste-residue remover is not operably associated with said photo conductor drum.

12. The toner cartridge of claim 9 wherein:

said toner cartridge is a non waste-residue collecting toner cartridge in said first operating condition and a waste-residue collecting toner cartridge in said second operating condition.

13. The toner cartridge of claim 9 and further comprising a door in said housing.

14. The toner cartridge of claim 9 wherein said door is releasably retained in a closed configuration in relation to said housing.

15. The toner cartridge of claim 9 wherein said waste-residue collection site is a waste-residue hopper.

16. The toner cartridge of claim 11 wherein said waste-residue remover is a scraper.

* * * * *